US007726322B2

(12) United States Patent
Cho

(10) Patent No.: US 7,726,322 B2
(45) Date of Patent: Jun. 1, 2010

(54) COSMETICS CASE

(76) Inventor: Kyu Suk Cho, 1312-1404 Sinsigaji APT., 327, Sinjeong6-dong, Yangcheon-gu, Seoul 158-773 (KR)

( * ) Notice: Subject to any disclaimer, the term of this patent is extended or adjusted under 35 U.S.C. 154(b) by 427 days.

(21) Appl. No.: 11/768,028

(22) Filed: Jun. 25, 2007

(65) Prior Publication Data

US 2008/0276956 A1 Nov. 13, 2008

(30) Foreign Application Priority Data

May 9, 2007 (KR) ..... 20-2007-0007653 U

(51) Int. Cl.
*A45D 33/24* (2006.01)
*A45D 33/22* (2006.01)
*A45D 33/02* (2006.01)

(52) U.S. Cl. ..... 132/294; 132/295; 132/298

(58) Field of Classification Search ..... 132/293–298, 132/307, 306, 300, 305; 206/581, 823
See application file for complete search history.

(56) References Cited

U.S. PATENT DOCUMENTS 1,801,762 A * 4/1931 Brun ..... 132/307
2,076,549 A * 4/1937 Conner ..... 215/6
6,354,308 B1 * 3/2002 Kuk ..... 132/301

* cited by examiner

*Primary Examiner*—Robyn Doan
(74) *Attorney, Agent, or Firm*—Birch, Stewart, Kolasch & Birch, LLP

(57) ABSTRACT

The present invention relates to a cosmetics case including a cover having a lock protrusion and a hinge protrusion; a base case to which the cover is pivotally connected; an intermediate case installed in the base case and in which a button and a spring are installed; a powder case receiving solid powder therein, installed in the intermediate case and supported by the spring; and a grinding member rotatably installed in a coupling groove of the intermediate case to grind the surface of the solid powder received in the powder case. The present invention provides the cosmetics case capable of rotating in both directions, in which rotation in one direction permits grinding of the solid powder and rotation in the other direction permits pressing down of the surface of the solid powder, thereby preventing the ground powder from being discharged outwards, and after use, the cover is closed to prevent impurities from being put into the solid powder.

2 Claims, 8 Drawing Sheets

COSMETICS CASE

BACKGROUND OF THE INVENTION

1. Field of the Invention

The present invention relates to a cosmetics case for grinding solid powder, and in particular, to a cosmetics case with which a user grinds and uses a desired amount of solid powder, and, after using the powder, closes a cover to prevent the ground powder from being discharged outwards.

2. Description of the Related Art

Generally, cosmetics containers, for example a powder case, are variously developed according to their structures such as a type and opening and closing methods of a cover. Most women carrying facial powder in their handbags or bags take out and use the powder for beauty at a proper time.

Therefore, most consumers demand cosmetics containers to be compact, and to be convenient to carry and use. To meet the demands, manufacturers try to produce cosmetics containers that are convenient to use.

FIG. 1 is an exploded perspective view of a conventional cosmetics case for grinding solid powder, and FIG. 2 is a side cross-sectional view of the cosmetics case of FIG. 1 in a coupled state.

Referring to FIGS. 1 and 2, the conventional cosmetics case 100 for grinding solid powder and discharging the ground powder includes a lower body 103 having a lock protrusion 102 formed along an outer periphery thereof; a molded member 105 inserted into the lower body 103, being vertically movable and having a guide protrusion 104 formed along an outer periphery thereof; a reservoir 106 inserted into and fixed to the molded member 105 for receiving solid powder; a stop member 108 formed of a circular ring, having a protrusion fixing element 107 formed along an upper portion of an inner periphery thereof and having an one direction-oriented saw 101 formed along a lower portion of the inner periphery thereof; a rotatable cutting member 110 located above the solid powder and having a plurality of cutting grooves 109 formed on the bottom thereof; a rotatable member 111 rotatably fixing the rotatable cutting member 110 to the lower body 103; and a spring 112 to be fixed between the molded member 105 and the lower body 103.

The conventional cosmetics case 100 includes the above-described seven components, and the lower body 103 is formed of a double structure, thereby increasing production costs because many processes are required to produce the cosmetics case 100.

Further, when a user uses the cosmetics case 100, noise is generated due to click caused at a specified interval when rotating the cosmetics case 100.

The conventional cosmetics case 100 has the rotatable cutting member 110 that can not be rotated in the opposite direction of a direction for grinding powder after grinding the powder, and thus does not have a function of pressing down the ground powder.

The conventional cosmetics case 100 is open at its upper end, and thus the ground powder tends to be discharged outwards when a user carries the cosmetics case 100, for example in a handbag.

Further, the conventional cosmetics case 100 maintains an open state, and thus the ground powder is stained with impurities. In the case that a user uses the stained powder without knowing it, the user should remove her makeup and apply a new makeup.

The user is reluctant to use the powder stained with impurities, and thus throws away the stained powder, thereby causing an unnecessary waste.

SUMMARY OF THE INVENTION

The present invention provides a cosmetics case capable of rotating in both directions, in which rotation in one direction permits grinding of solid powder and rotation in the other direction permits pressing down of the surface of the solid powder, thereby preventing the ground powder from being discharged outwards while a user carries the cosmetics case.

The present invention further provides a cosmetics case, in which the solid powder is located adjacently below a rotatable member by tension of a spring installed in an intermediate case for supporting the bottom of a powder case, thereby easily grinding the solid powder.

The present invention further provides a cosmetics case, in which the spring is located at a fixed position by spring fixing protrusions of the intermediate case, and thus tension of the spring is uniformly applied to a central portion of the powder case, thereby easily grinding the solid powder.

In order to achieve the above-described objects, the present invention provides a cosmetics case for grinding solid powder, including: a cover having a lock protrusion and a hinge protrusion; a base case to which the cover is pivotally connected; an intermediate case installed in the base case and in which a button and a spring are installed; a powder case for receiving the solid powder therein that is installed in the intermediate case and supported by the spring; and a grinding member rotatably installed in a coupling groove of the intermediate case to grind the surface of the solid powder received in the powder case.

BRIEF DESCRIPTION OF THE DRAWINGS

The above and other objects, features and advantages of the present invention will become more apparent from the following detailed description in conjunction with the accompanying drawings, in which.

DETAILED DESCRIPTION OF EXEMPLARY EMBODIMENTS

Exemplary embodiments of the present invention are described with reference to the accompanying drawings in detail. The same reference numbers are used throughout the drawings to refer to the same or like parts. Detailed description of well-known functions and structures incorporated herein may be omitted to avoid obscuring the subject matter of the present invention.

Figure 1:
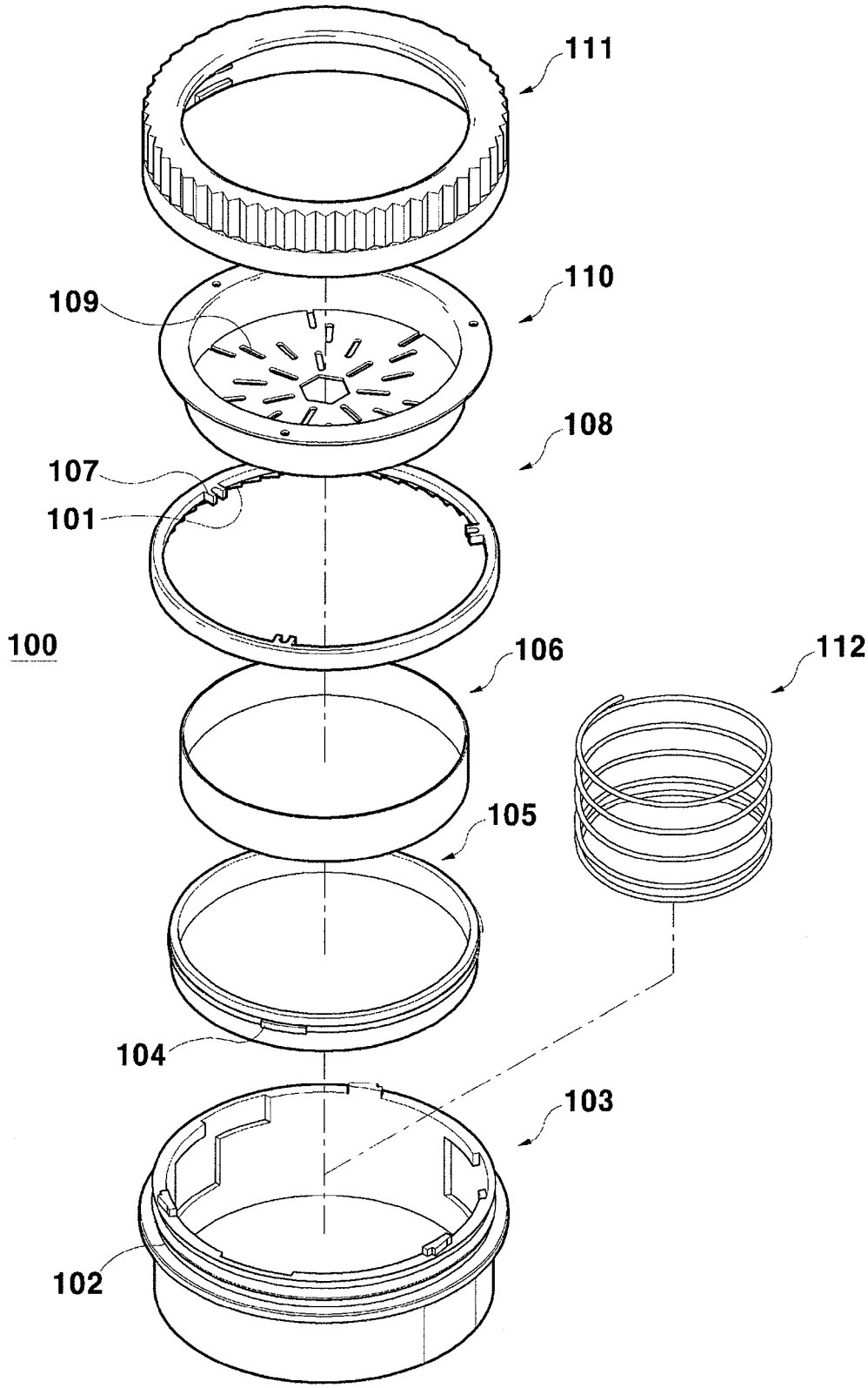
FIG. 1 Prior Art
FIG. 1 is an exploded perspective view of a conventional cosmetics case for grinding solid powder.
Figure 2:
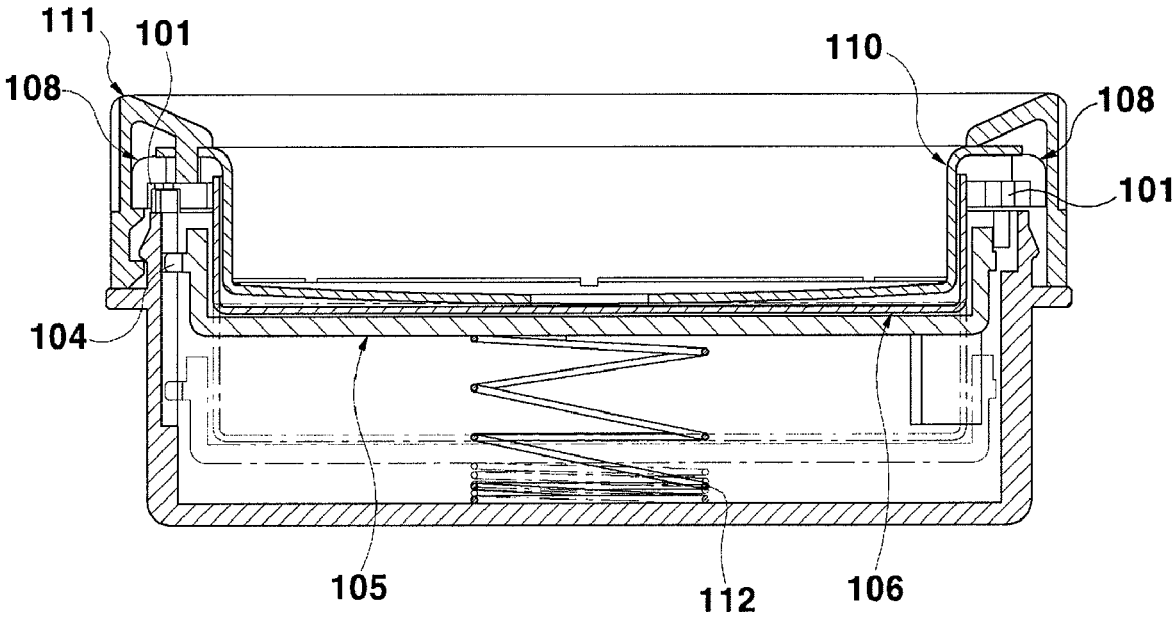
FIG. 2 Prior Art
FIG. 2 is a side cross-sectional view of the cosmetics case of FIG. 1 in a coupled state.
Figure 3:
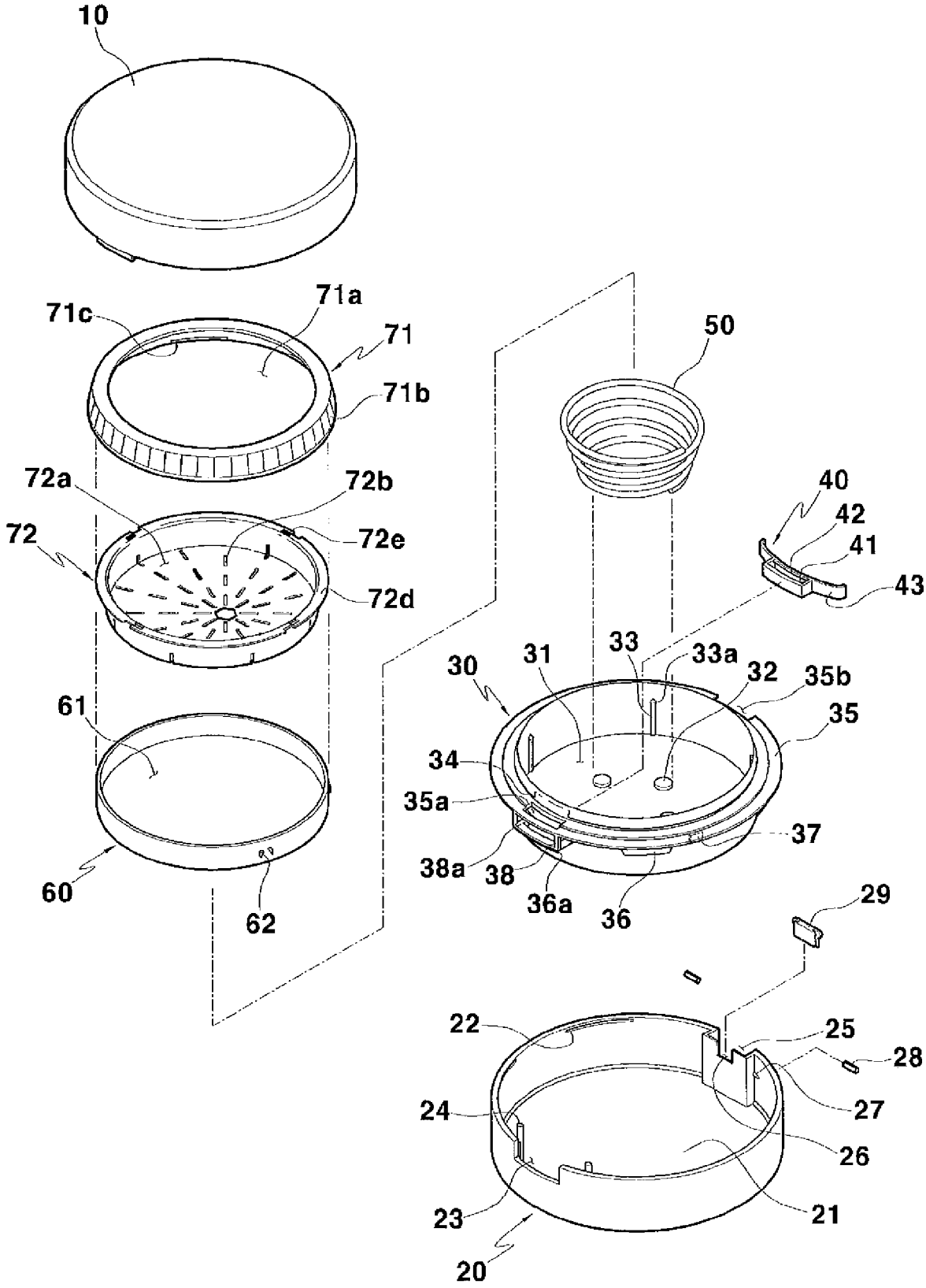
FIG. 3 is an exploded perspective view illustrating a configuration of a cosmetics case according to an exemplary embodiment of the present invention.
Figure 4:
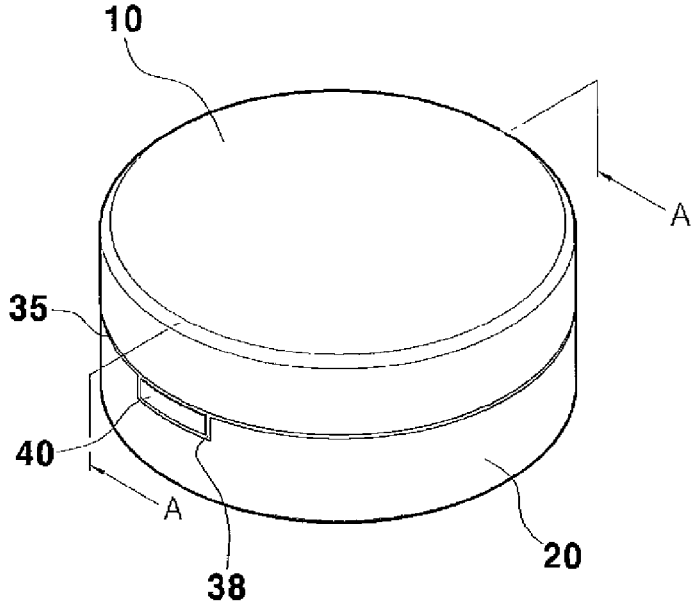
FIG. 4 is a perspective view of a coupled state of the cosmetics case of FIG. 3.
Figure 5:
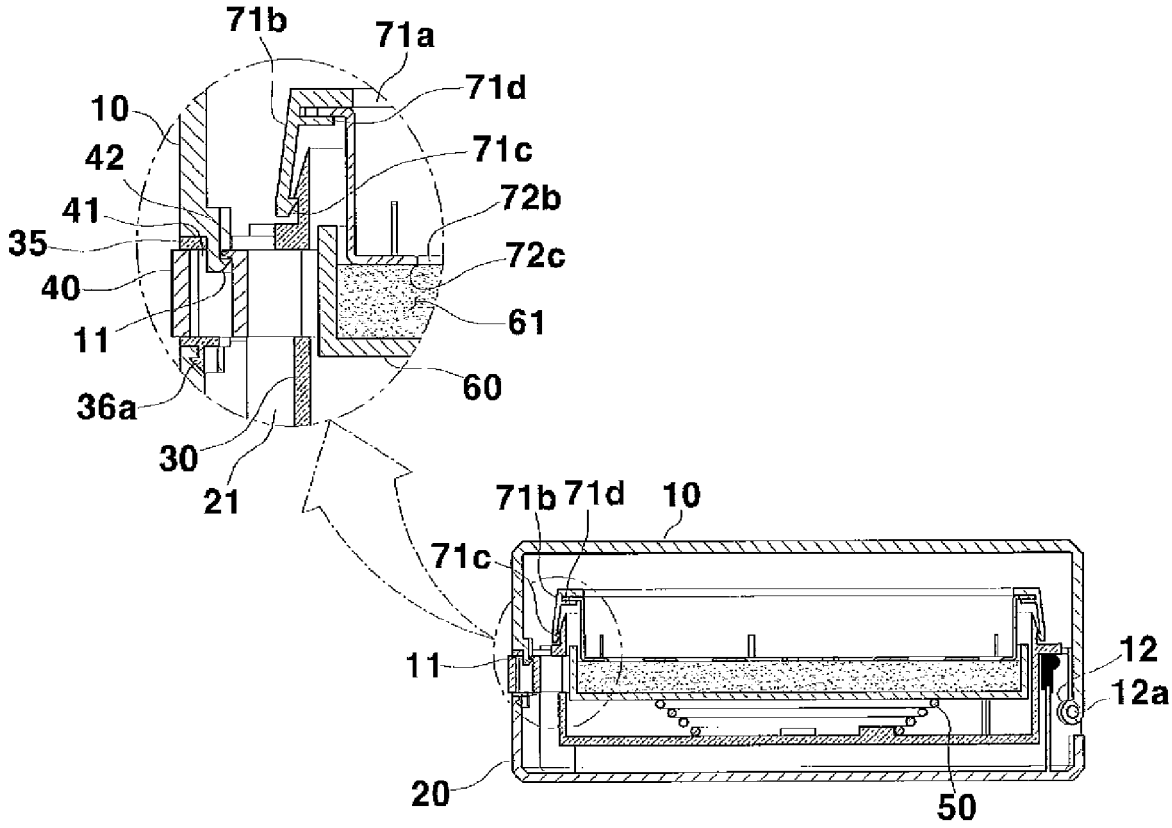
FIG. 5 is a cross-sectional view of a coupled configuration of FIG. 4.
Figure 6:
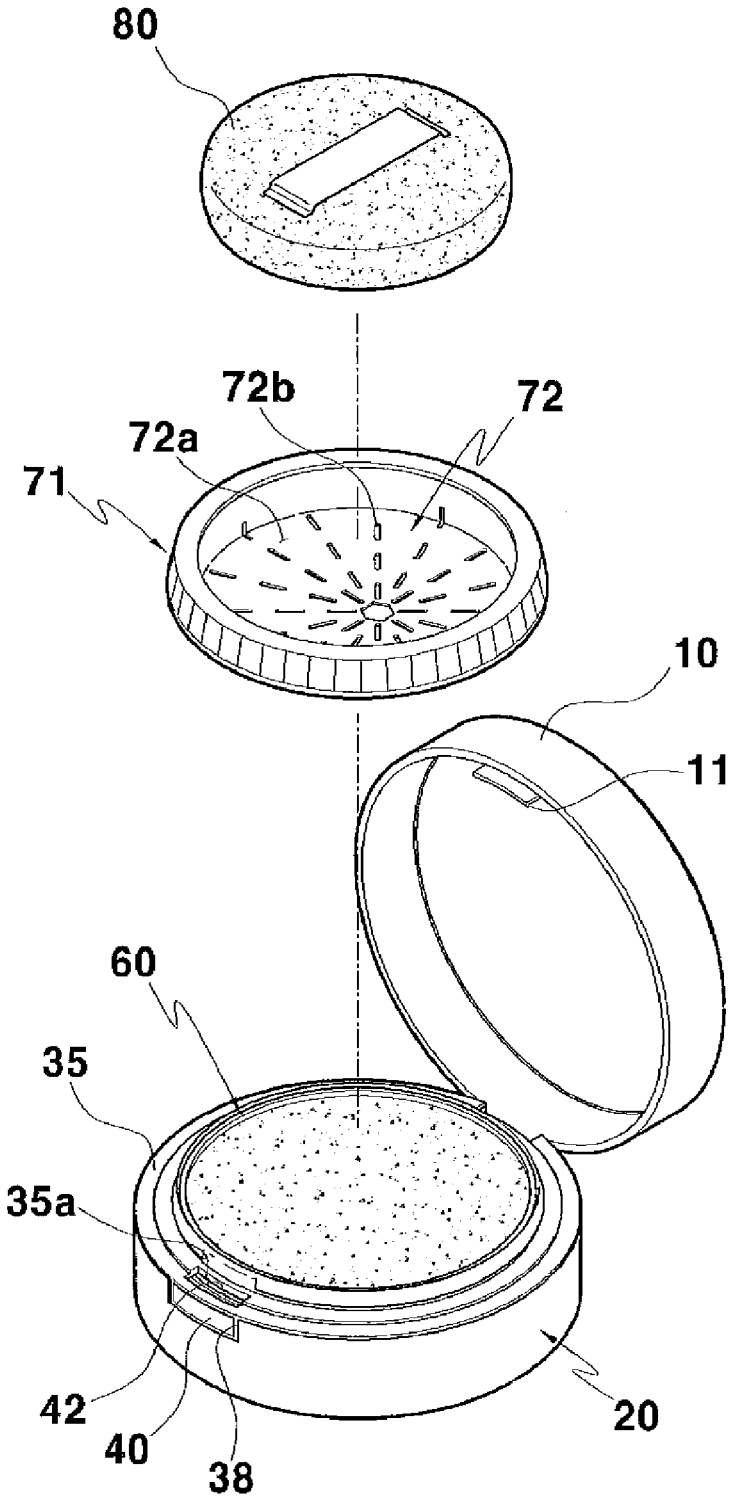
FIG. 6 is a perspective view illustrating the cosmetics case containing solid powder according to the present invention.
Figure 7:
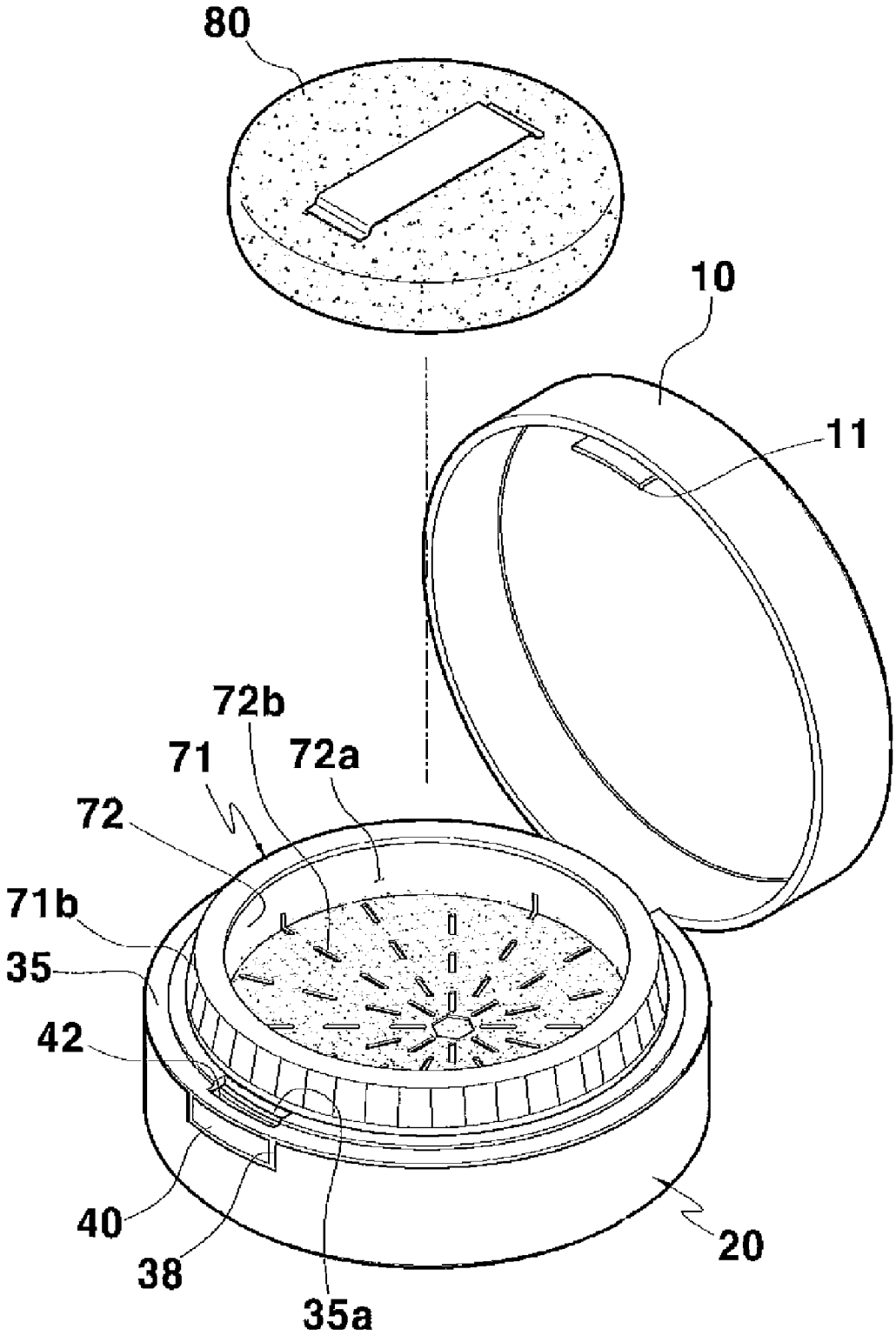
FIG. 7 is a perspective view illustrating application of the cosmetics case according to the present invention.
Figure 8:
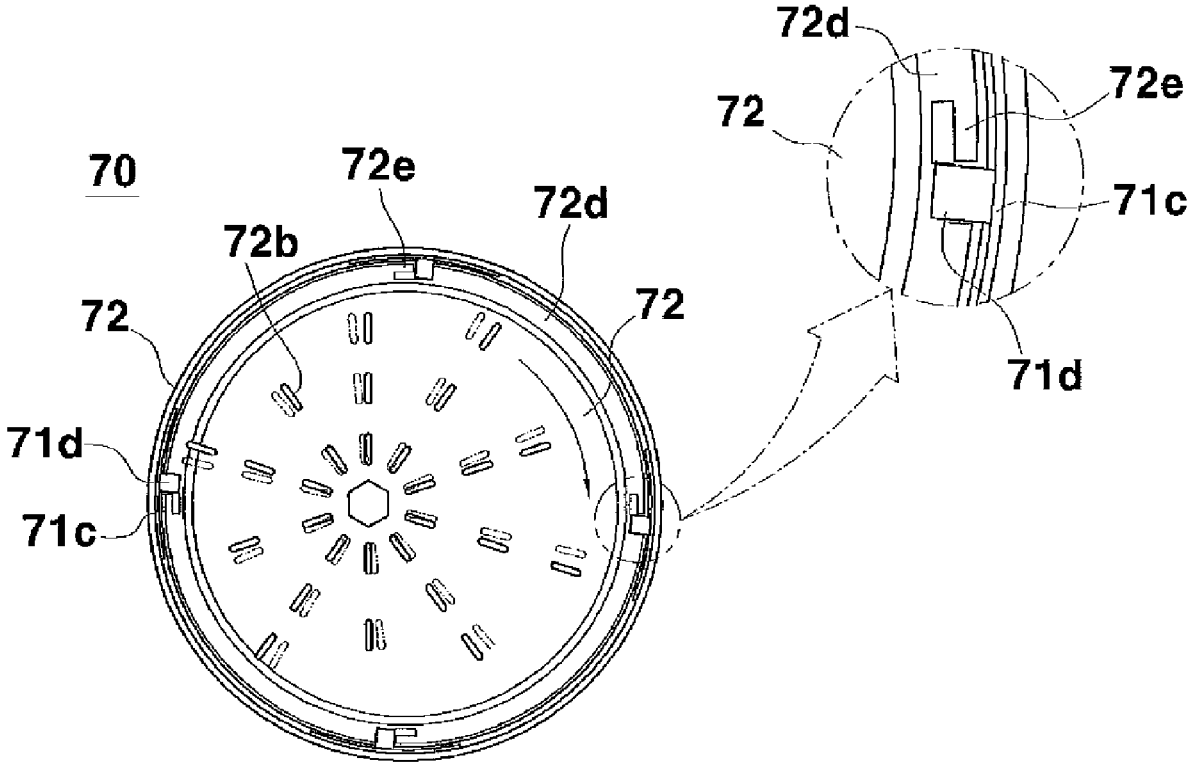
FIG. 8 is a bottom view of a configuration illustrating that a rotatable member is coupled to a rotatable wheel according to the present invention.
Figure 9:
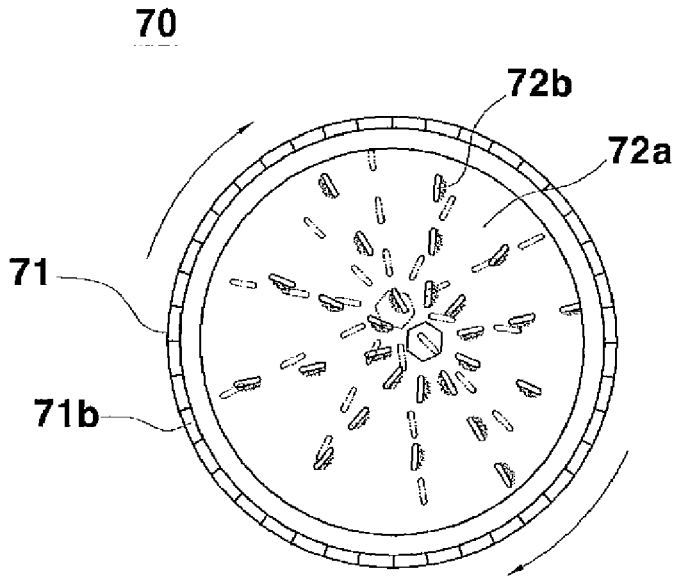
FIG. 9 is a plan view illustrating that the solid powder is ground by rotation of the rotatable wheel according to the present invention.
Figure 10:
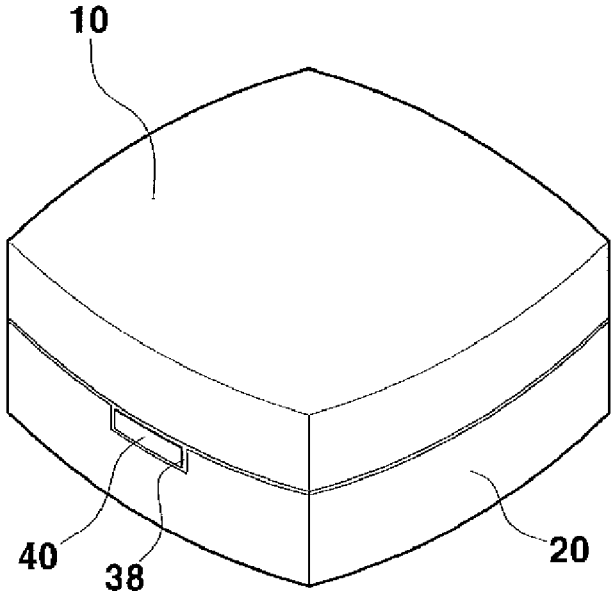
FIG. 10 is a perspective view of a cosmetics case according to another exemplary embodiment of the present invention.

FIG. 3 is an exploded perspective view illustrating a configuration of a cosmetics case according to an exemplary embodiment of the present invention. FIG. 4 is a perspective view of a coupled state of the cosmetics case of FIG. 3, FIG. 5 is a cross-sectional view of a coupled configuration of FIG. 4, FIG. 6 is a perspective view illustrating the cosmetics case containing solid powder according to the present invention, FIG. 7 is a perspective view illustrating application of the cosmetics case according to the present invention, FIG. 8 is a bottom view of a configuration illustrating that a rotatable member is coupled to a rotatable wheel according to the present invention, FIG. 9 is a plan view illustrating that the solid powder is ground by rotation of the rotatable wheel according to the present invention, and FIG. 10 is a perspective view of a cosmetics case according to another exemplary embodiment of the present invention.

As shown in FIGS. 3 to 10, the cosmetics case of the present invention includes a cover 10, a base case 20, an intermediate case 30, a button 40, a spring 50, a powder case 60, and a grinding member 70.

The cover 10 is pivotally connected to the base case 20 and movable from a closed position to an open position, and includes a lock protrusion 11 formed at a portion thereof and a hinge protrusion 12 formed at the opposite side of the lock protrusion 11 and having an insertion hole 12*a* for rotatably fixing to the base case 20.

The base case 20 has a space part 21 for receiving the intermediate case 30, and a plurality of fixing grooves 22 formed along an inner periphery of the space part 21 for connection to the intermediate case 30.

A button groove 23 is formed at a portion of the base case 20, and guide posts 24 are formed in the space part 21 near the button groove 23.

A hinge protrusion insertion groove 25 is formed at the opposite side of the button groove 23 for receiving the hinge protrusion 12 of the cover 10, and has a notch 26 formed at a portion thereof.

A pin hole 27 is formed at a portion of an outer periphery of the base case 20 having the hinge protrusion insertion groove 25, and a pin 28 is inserted into the pin hole 27 and the insertion hole 12*a* of the hinge protrusion 12 for rotating the cover 10.

A finishing element 29 made of rubber is installed in the notch 26 adjacent to a portion of the intermediate case 30 which is received in the space part 21 of the base case 20.

The intermediate case 30 has a receiving part 31 for receiving the powder case 60 and a plurality of spring fixing protrusions 32 formed on the bottom of the receiving part 31.

A plurality of rotation preventing protrusions 33 are formed along an inner periphery of the intermediate case 30 for preventing rotation of the powder case 60 received in the intermediate case 30 and facilitating a vertical movement of the powder case 60, and separation preventing protrusions 33*a* are formed at upper ends of the rotation preventing protrusions 33 for preventing the powder case 60 from separating from the intermediate case 30 when the powder case 60 moves upwards.

An upper outer periphery of the intermediate case 30 is inclined at a predetermined angle, and a coupling groove 34 is formed along the inclined upper outer periphery of the intermediate case 30.

A brim 35 is formed near the coupling groove 34 along the outer periphery of the intermediate case 30 such that the intermediate case 30 is located on the base case 20 when the intermediate case 30 is received in the space part 21 of the base case 20.

A hollow 35*a* is formed at a portion of the brim 35 and a hinge opening 35*b* is formed on the opposite side of the hollow 35*a* at the brim 35.

A plurality of fixing elements 36 are formed under the brim 35 at an equal interval for connection to the fixing grooves 22 formed on the inner periphery of the base case 20, each of the fixing elements 36 has a fixing protrusion 36*a*, and reinforcing protrusions 37 are formed between the fixing elements 36 and contacted with the inner periphery of the base case 20.

A button installation protrusion 38 is formed on a lower surface of the brim 35 and has a button installation hole 38*a* connected with the hollow 35*a*.

The button 40 is installed in the bottom installation protrusion 38 such that the button 40 protrudes through one side of the button installation hole 38*a*, and has a through hole 41 vertically penetrating through the button 40 and a step 42 formed at a portion of the through hole 41.

A side section 43 is formed at both sides of the button 40 and supported by the guide posts 24.

The spring 50 is coupled to the spring fixing protrusions 32 formed on the receiving part 31 of the intermediate case 30, and has a larger diameter in the upper portion than in the lower portion to support the bottom of the powder case 60.

The powder case 60 is open at its upper end and installed on the spring 50 located in the receiving part 31 of the intermediate case 30, and has a powder receiving part 61 for receiving solid powder.

Coupling element pairs 62 are formed on an outer periphery of the powder case 60 at an equal interval, and may be engaged with the rotation preventing protrusions 33 of the intermediate case 30.

A separation between the two elements of each coupling element pair 62 is narrower at the top than at the bottom for preventing separation from the rotation preventing protrusions 33.

The grinding member 70 includes a rotatable wheel 71 coupled to the intermediate case 30, and a rotatable member 72 installed below the inside of the rotatable wheel 71 for grinding the solid powder received in the powder receiving part 61 of the powder case 60.

The rotatable wheel 71 has an opening 71*a* vertically penetrating through the rotatable wheel 71, and a grip 71*b* formed along an outer periphery of the rotatable wheel 71 for preventing slip of a user's hand during rotation of the rotatable wheel 71.

A plurality of coupling protrusions 71*c* are formed at a lower portion of an inner periphery of the rotatable wheel 71 in four directions to be engaged with the coupling groove 34 of the intermediate case 30, and protruded steps 71*d* are formed above the coupling protrusions 71*c* for fixing the rotatable member 72.

The rotatable member 72 includes a reservoir 72*a* made of a metal and open at its upper end for receiving the ground powder, a plurality of apertures 72*b* formed at the bottom of the reservoir 72*a*, and grinding blades 72*c* formed at lower portions of the apertures 72*b* for grinding the surface of the solid powder.

The apertures 72*b* having the grinding blades 72*c* are biasedly arranged on the bottom of the rotatable member 72.

A circumferential section 72*d* is formed along an outer periphery of the rotatable member 72, and engaging elements 72*e* are formed at the circumferential section 72*d* at an equal interval.

Each of the engaging elements 72*e* has a cut portion and the other portion fixed to the circumferential section 72*d*, and the engaging elements 72*e* are engaged with the protruded steps 71*d* of the rotatable wheel 71=

A puff 80 is located in the rotatable member 72 to use the ground powder through the opening 71*a* of the rotatable wheel 71 in a state that the rotatable member 72 is coupled to the rotatable wheel 71.

Although the drawings show the cover 10 and the base case 20 formed of a circle, and the cover 10 and the base case 20 may be formed of a square as shown in FIG. 10.

The shapes of the cover 10 and the base case 20 are not limited to a circle or a square, and may vary according to manufacturers.

According to the present invention having the above-described configuration, to use the solid powder, firstly, the button 40 protruding from a portion of the base case 20 is pressed to release a lock state in which the lock protrusion 11 is engaged with the step 42 of the through hole 41 of the button 40.

When the button 40 is pressed, the lock protrusion 11 is separated from the step 42 of the button 40, and the cover 10 is pivoted with regard to the pin 28 inserted into the insertion hole 12*a* of the hinge protrusion 12 to open the cover 10.

When the cover 10 is in an open state, the user grasps and rotates the rotatable wheel 71 of the grinding member 70, and the rotatable member 72 coupled to the rotatable wheel 71 is rotated.

While rotated in a direction, the rotatable member 72 grinds the surface of the solid powder received in the powder receiving part 61 of the powder case 20.

At this time, the solid powder is ground by the grinding blades 72*c* formed at portions of the apertures 72*b*, and the ground powder is flowed into the reservoir 72*a* through the apertures 72*b*.

When the rotatable wheel 71 is rotated, the rotatable member 72 is not separated from the rotatable wheel 71 but moves with the rotatable wheel 71. This is because the circumferential section 72*d* of the rotatable member 72 is engaged with the protruded step 71*d* of the rotatable wheel 71 and fixed by the engaging elements 72*e* coupled to the protruded step 71*d*, thereby realizing a stable rotation.

When the ground powder is flowed into the reservoir 72*a*, the user makes up using the puff 80 accommodated in the reservoir 72*a*.

If the amount of the ground powder is insufficient, the user grinds more solid powder in the above-described manner and uses the ground powder.

Elasticity of the spring 50 installed in the receiving part 31 of the intermediate case 30 is applied to the bottom of the powder case 60 receiving the solid powder therein, so that the solid powder is located adjacently below the rotatable member 72, thereby easily grinding the solid powder.

When the rotatable member 72 is rotated, the powder case 60 is not rotated. This is because the coupling element pairs 62 formed along the outer periphery of the powder case 60 are engaged with the rotation preventing protrusions 33 of the intermediate case 30 to prevent the power case 60 from rotating according to rotation of the rotatable member 72 while grinding the solid powder.

Even though the powder case 60 is moved upwards by the spring 50, the powder case 60 is not separated from the intermediate case 30. This is because the upper ends of the coupling elements 62 formed along the outer periphery of the powder case 60 are stuck in the separation preventing protrusions 33*a* of the rotation preventing protrusions 33 of the intermediate case 30, thereby preventing separation of the powder case 60 from the intermediate case 30.

The spring 50 is coupled to the spring fixing protrusions 32 formed in the receiving part 31 of the intermediate case 30 to maintain a fixed position, and thus elasticity of the spring 50 supporting the bottom of the powder case 60 is uniformly applied to the central portion of the bottom of the powder case 60.

The spring 50 pushes the bottom of the powder case 60 at a fixed position, and thus the solid powder is easily ground by the grinding blades 72*c* of the rotatable member 72.

The apertures 72*b* having the grinding blades 72*c* are biasedly arranged on the bottom of the rotatable member 72, which solves a problem of conventional cosmetics cases that the solid powder received in the powder receiving part 61 corresponding to a central portion of the rotatable member 72 is not ground, and thus enables the user to grind and use the whole solid powder.

As described above, because the spring 50 installed in the intermediate case 30 is located at a fixed position by the spring fixing protrusions 32, the powder case 60 is pushed upwards by elasticity of the spring 50 and becomes close to the grinding blades 72*c* formed at the apertures 72*b* of the rotatable member 72.

Thus, the solid powder received in the powder case 60 is located adjacently below the rotatable wheel 71, and the solid powder is ground and flowed into the reservoir 72*a* of the rotatable member 72 only by rotation of the rotatable wheel 71 exerted by the user.

After the solid powder is ground and flowed into the reservoir 72*a*, the user makes up using the puff 80.

After makeup, if the user grasps and rotates the rotatable wheel 71 in the opposite direction to a direction for grinding, the rotatable member 72 coupled to the rotatable wheel 71 is rotated, and thus the ground powder is pressed down by the grinding blades 72*c* formed at the apertures 72*b*, thereby preventing the powder from being discharged outwards.

After makeup is completed, when the cover 10 is moved to a closed position, the bottom of the cover 10 is closely coupled to the top of the base case 20, and the lock protrusion 11 is stuck in the step 42 formed at the through hole 41 of the button 40, thereby closing the cover 10.

Therefore, though the user carries the cosmetic case, for example in a handbag, the present invention prevents the ground powder from being discharged outwards by swing.

As such, the present invention provides the cosmetics case capable of rotating in both directions, in which rotation in one direction permits grinding of the solid powder and rotation in the other direction permits pressing down of the surface of the solid powder, and thus the present invention prevent the ground powder from being discharged outwards while a user carries the cosmetics case.

The solid powder is located adjacently below the rotatable member by tension of the spring installed in the intermediate case, thereby easily grinding the solid powder.

The spring is located at a fixed position by the spring fixing protrusions of the intermediate case, and thus tension of the spring is uniformly applied to the central portion of the bottom of the powder case, thereby easily grinding the solid powder.

Further, the cosmetics case includes the base case and the cover for sealing the cosmetics case, and thus the ground powder is not discharged outwards, thereby preventing undesired staining of surrounding areas with the discharged powder.

While exemplary embodiments of the present invention have been shown and described in this specification, it will be understood by those skilled in the art that various changes or modifications of the embodiments are possible without departing from the spirit and scope of the invention as defined by the appended claims.

What is claimed is:

1. A cosmetics case for grinding solid powder, the cosmetics case comprising:

a cover having a lock protrusion and a hinge protrusion;

a base case to which the cover is pivotally connected;

an intermediate case installed in the base case and in which a button and a spring are installed;

a powder case for receiving the solid powder therein and installed in the intermediate case and supported by the spring; and a grinding member rotatably installed in a coupling groove of the intermediate case for grinding the surface of the solid powder received in the powder case, wherein the intermediate case comprises:

a receiving part that is open at its upper end for receiving the powder case, spring fixing protrusions formed on the receiving part for fixing the spring, a plurality of rotation preventing protrusions formed on an inner periphery of the receiving part for connection to the powder case, a coupling groove formed around an outer periphery of the intermediate case, a brim formed along the outer periphery of the intermediate case, a coupling groove installed in the brim to accommodate the lock protrusion of the cover, and a button installation protrusion formed at a portion of the brim and having a button installation hole, wherein the button is coupled to the button installation protrusion and supported by guide posts.

2. The cosmetics case of claim 1, wherein a plurality of the rotation preventing protrusions are biasedly formed on the inner periphery of the intermediate case, and each of the rotation preventing protrusions has a separation preventing protrusion formed at an upper end for preventing separation of the powder case supported by the spring from the intermediate case.

* * * * *

US007726322C1

(12) EX PARTE REEXAMINATION CERTIFICATE (8189th)

United States Patent
Cho

(10) Number: US 7,726,322 C1
(45) Certificate Issued: Apr. 26, 2011

(54) COSMETICS CASE

(76) Inventor: Kyu Suk Cho, Seoul (KR)

Reexamination Request:
No. 90/009,799, Sep. 23, 2010

Reexamination Certificate for:

| | |
|---|---|
| Patent No.: | **7,726,322** |
| Issued: | **Jun. 1, 2010** |
| Appl. No.: | **11/768,028** |
| Filed: | **Jun. 25, 2007** |

(51) Int. Cl.

| | |
|---|---|
| ***A45D 33/24*** | (2006.01) |
| ***A45D 33/22*** | (2006.01) |
| ***A45D 33/02*** | (2006.01) |

(52) U.S. Cl. ..... 132/294; 132/295; 132/298
(58) Field of Classification Search ..... 132/294
See application file for complete search history.

(56) References Cited

U.S. PATENT DOCUMENTS 2,076,549 A * 4/1937 Conner ..... 215/6
6,354,308 B1 * 3/2002 Kuk ..... 132/301

FOREIGN PATENT DOCUMENTS

KR 20-0159437 * 10/1999
KR 10-2004-0025254 * 3/2004

* cited by examiner

*Primary Examiner*—Cary E. Wehner

(57) ABSTRACT

The present invention relates to a cosmetics case including a cover having a lock protrusion and a hinge protrusion; a base case to which the cover is pivotally connected; an intermediate case installed in the base case and in which a button and a spring are installed; a powder case receiving solid powder therein, installed in the intermediate case and supported by the spring; and a grinding member rotatably installed in a coupling groove of the intermediate case to grind the surface of the solid powder received in the powder case. The present invention provides the cosmetics case capable of rotating in both directions, in which rotation in one direction permits grinding of the solid powder and rotation in the other direction permits pressing down of the surface of the solid powder, thereby preventing the ground powder from being discharged outwards, and after use, the cover is closed to prevent impurities from being put into the solid powder.

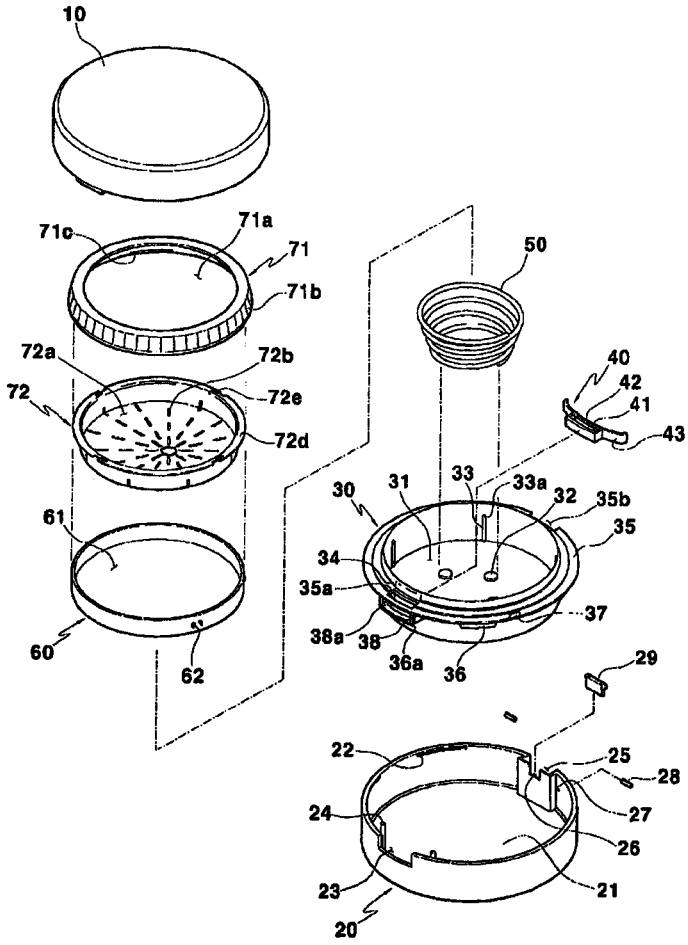

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2 is confirmed.

* * * * *